United States Patent [19]

Silvers et al.

[11] Patent Number: 4,487,194

[45] Date of Patent: Dec. 11, 1984

[54] AERO CIRCULATOR STOVE

[76] Inventors: Richard A. Silvers, 119 N. Lot #D; Joseph English; Lester English, both of 67809 E. Highway 50, all of Montrose, Colo. 81401

[21] Appl. No.: 522,963

[22] Filed: Aug. 15, 1983

[51] Int. Cl.[3] ..... F24B 3/00

[52] U.S. Cl. ..... 126/67; 126/118

[58] Field of Search ..... 126/67, 61, 63, 66, 126/118, 99 R, 99 C, 99 D, 118; 237/69, 47, 48; 165/185

[56] References Cited

U.S. PATENT DOCUMENTS

| | | | |
|---|---|---|---|
| 692,164 | 1/1902 | Miller | 126/67 |
| 893,197 | 7/1908 | Richardson | 126/118 |
| 907,044 | 12/1908 | Harr | 126/67 |
| 974,581 | 11/1910 | Max | 126/118 |
| 1,389,194 | 8/1921 | Harris | 126/118 |
| 1,571,785 | 2/1926 | Belvin | 126/67 |
| 1,713,768 | 5/1929 | McClernon | 126/67 |
| 2,430,227 | 11/1947 | Jensen | 126/118 |
| 3,362,394 | 1/1968 | Cole | 126/63 |
| 4,180,051 | 12/1979 | Maier | 126/67 |
| 4,258,693 | 3/1981 | Baker | 126/67 |
| 4,261,323 | 4/1981 | Horwinski | 126/63 |
| 4,287,871 | 9/1981 | Schumann | 126/67 |
| 4,328,784 | 5/1982 | Cox | 126/67 |
| 4,369,761 | 1/1983 | Burnette | 126/67 |
| 4,421,095 | 12/1983 | Kreis | 126/118 |

*Primary Examiner*—Daniel J. O'Connor

[57] ABSTRACT

This invention is a household stove for heating the household air; including a fire box surrounded by a jacket, through which the room air circulates, and a duct unit attached to a cold air intake side of the jacket, the duct unit including branches to collect cold air from distant areas of the room.

1 Claim, 9 Drawing Figures

FIG. 1
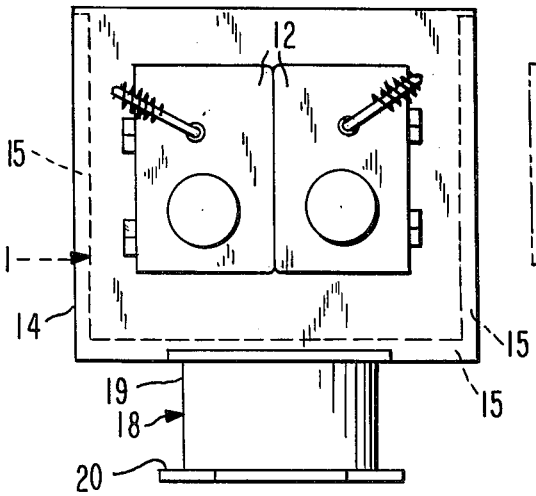
FIG. 2
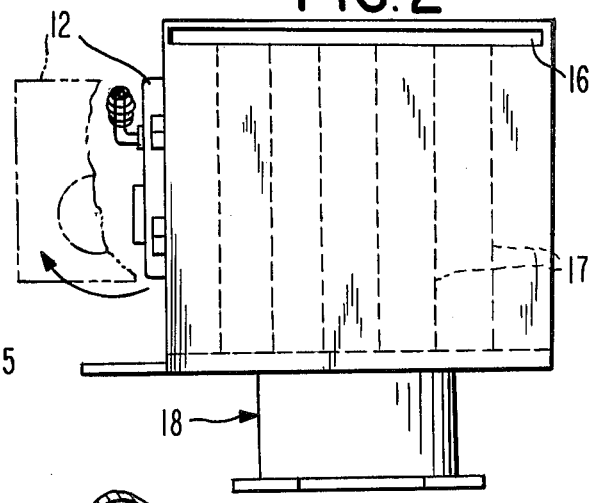
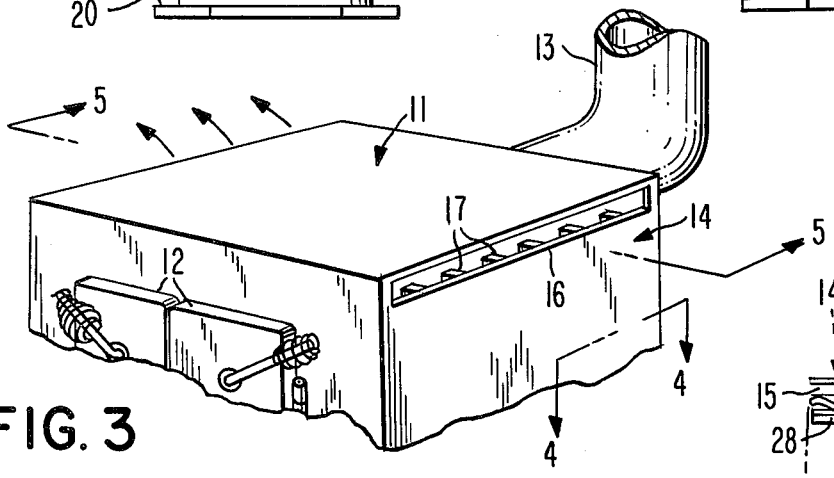
FIG. 3
FIG. 4
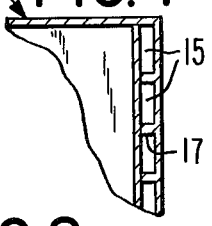
FIG. 8
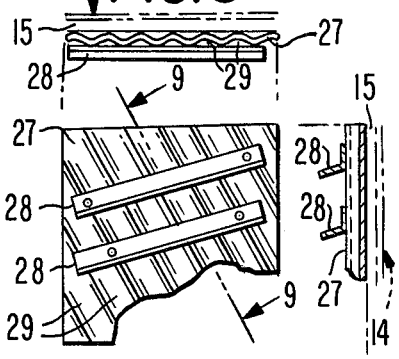
FIG. 7 FIG. 9
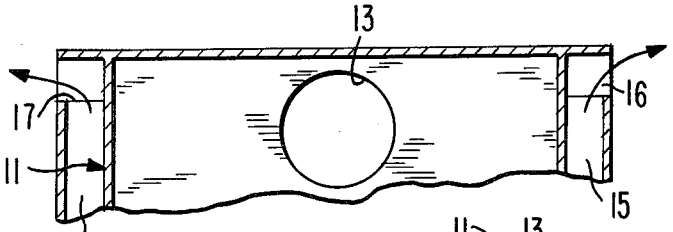
FIG. 5
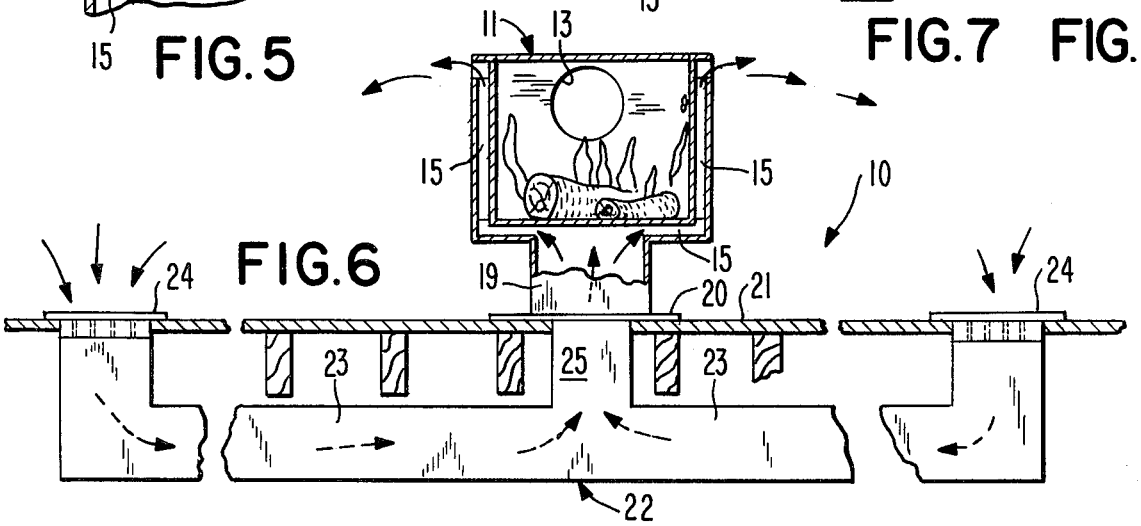
FIG. 6

AERO CIRCULATOR STOVE

This invention relates generally to stoves, such as are used for heating the air inside a home.

It is well known that such stoves, presently in use, rely on fans or blowers for circulating the air through the stove, so that this involves extra electrical costs for powering the same.

It is a principal object of the present invention to provide a wood or coal fired stove, which will evenly heat the air of a home without the use of a fan or blower.

Another object is to provide an aero circulator stove, which alternately may be installed in a home that has an existing forced air heating system, by simply attaching the stove air intake to the furnace hot air duct.

Other objects are to provide an aero circulator stove, which is simple in design, inexpensive to manufacture, rugged in construction, easy to use, and efficient in operation.

These, and other objects, will be readily evident, upon a study of the following specification, and the accompanying drawing, wherein:

FIG. 1 is a front elevation view of the stove invention;

FIG. 2 is a side elevation view thereof;

FIG. 3 is a fragmentary perspective view thereof;

FIG. 4 is a cross-sectional view, taken on line 4—4 of FIG. 3;

FIG. 5 is a cross-sectional view, taken on line 5—5 of FIG. 3;

FIG. 6 is a front elevation view of the stove, shown partly in cross-section, and shown installed as a home heating system;

FIG. 7 is an inner side view of another design of stove fire box wall, which is corrugated angularly, and includes flame guides, so as to direct flames thereto, in order to obtain still greater heat adjacent the stove air passages;

FIG. 8 is a top plan view thereof, and

FIG. 9 is a side cross-sectional view, taken on line 9—9 of FIG. 7.

Referring now to the drawing in greater detail, and more particularly, to FIGS. 1 to 6 thereof, at this time, the reference numeral 10 represents an aero circulator stove, according to the present invention, wherein there is a fire box 11, having a hinged door or doors 12 on its front side, for feeding wood or coal therein. A chimney pipe 13 may extend outward from a rear side of the fire box.

As shown in the drawing, the fire box is encased within a jacket 14, that encloses the bottom and opposite sides of the fire box; the jacket providing an air space 15 around the outer side of the fire box. An opening 16, near an upper end of each side wall of the jacket, permits air from the air space to move outwardly from the stove and into the room of the house. The air space in the side walls may be partitioned with vertical fins or baffles 17, guiding the air flow upwardly toward the outlet openings.

The jacket is mounted upon a base 18, that comprises a vertical pipe 19, having a mounting flange 10 around its lower end, for installation upon a flooring 21 of the house. The pipe communicates at its upper end with the jacket air space, and communicates at its lower end with a duct unit 22, that is installed underneath the flooring.

The duct unit 22 comprises one or more duct branches 23, each one of which includes a duct air intake opening at one end fitted with a forced air type register 24, and which, at its opposite end, communicates with an air outlet collar 25, that is common to all the branches, and is connected to the pipe 19. As shown, in the drawing, the registers may be installed in the flooring of the same or other rooms of the house.

In operative use of the stove, as the air within the air space is heated by the fire box, the heated air rises out of the openings 16, and into the room, where, as it cools, it enters the registers, and recirculates again through the stove, for being reheated. If the house has a forced air heating system, then the pipe 19 is attached thereto, and the above-described duct unit 22 need not be installed.

In a modified design of aero circulator stove 26, shown fragmentarily in FIGS. 7 to 9, each opposite side wall 27 of the fire box is made of corrugated sheet metal, in which the corrugations extend upwardly at an inclined angle, and a plurality of angle irons 28 are secured to an inner side of the wall, being installed also inclined and at right angles to the corrugations. Each angle iron is obtuse angled in shape, so as to form an acute angle therebeneath, in order to serve as a flame guide inside the fire box. Thus, fire flames nearest the side walls 27, lapping the underside of the angle irons, are directed into the corrugation channels 29, for applying a more intense heat to the side wall, and the corrugation inclination provides the channels to be longer, in order for the flames to be in contact with the side wall for a longer time.

While various changes may be made in the detail construction, it is understood that such changes will be within the spirit and scope of the present invention, as is defined by the appended claims.

What we now claim is:

1. An aero circulator stove, comprising, a fire box inside a jacket, and means for air of a household room to circulate through said jacket; said means comprising a duct unit attached to an air intake side of said jacket; said duct unit including cold air entry registers located a substantial distance from hot air outlets of said jacket, so that heated air from said outlets travels said distance in said room to said registers; and said jacket including means for intensifying heat therewithin, said means comprising each opposite side wall of said fire box being made of corrugated sheet material in which the corrugations thereof extend upwardly at an inclined angle, and a plurality of angle irons are secured to an inner side of each said wall, said angle irons being horizontally inclined and at right angles to said corrugation.

* * * * *